US010422554B2

(12) United States Patent
Herzog et al.

(10) Patent No.: US 10,422,554 B2
(45) Date of Patent: Sep. 24, 2019

(54) DEVICE FOR COOLING A CONSUMER WITH A SUPER-COOLED LIQUID IN A COOLING CIRCUIT

(71) Applicant: MESSER GROUP GMBH, Bad Soden (DE)

(72) Inventors: Friedhelm Herzog, Krefeld (DE); Thomas Kutz, Brüggen-Born (DE)

(73) Assignee: MESSER GROUP GMBH, Bad Soden (DE)

( * ) Notice: Subject to any disclaimer, the term of this patent is extended or adjusted under 35 U.S.C. 154(b) by 487 days.

(21) Appl. No.: 14/901,627

(22) PCT Filed: Jun. 18, 2014

(86) PCT No.: PCT/EP2014/062881
§ 371 (c)(1),
(2) Date: Dec. 28, 2015

(87) PCT Pub. No.: WO2015/000708
PCT Pub. Date: Jan. 8, 2015

(65) Prior Publication Data

US 2016/0370036 A1 Dec. 22, 2016

(30) Foreign Application Priority Data

Jul. 4, 2013 (DE) ..... 10 2013 011 212

(51) Int. Cl.
*F25B 9/00* (2006.01)
*F25B 19/00* (2006.01)
(Continued)

(52) U.S. Cl.
CPC ..... *F25B 19/005* (2013.01); *F17C 9/00* (2013.01); *F17C 13/007* (2013.01);
(Continued)

(58) Field of Classification Search
CPC .. F17C 9/00; F17C 13/00; F17C 13/02; F17C 2227/0306; F17C 2227/0339;
(Continued)

(56) References Cited

U.S. PATENT DOCUMENTS 2,180,090 A * 11/1939 Mesinger ..... F17C 9/02 114/74 A
2,487,863 A 11/1949 Garretson
(Continued)

FOREIGN PATENT DOCUMENTS

DE 2929709 A1 2/1981
DE 102007011530 A1 9/2008
(Continued)

OTHER PUBLICATIONS

International Search Report for PCT/EP2014/062881, ISA/EP, Rijswijk, NL, dated Dec. 12, 2014.

*Primary Examiner* — Frantz F Jules
*Assistant Examiner* — Erik Mendoza-Wilkenfel
(74) *Attorney, Agent, or Firm* — Harness, Dickey & Pierce, P.L.C.

(57) ABSTRACT

A super-cooled liquid medium, preferably super-cooled liquid nitrogen, is pumped through a sub-cooler and cooled by the same medium that evaporates in the vacuum. This super-cooled nitrogen is used as coolant for a consumer. If a small amount of heat is emitted by the consumer to the nitrogen, the liquid medium can be guided in the circuit wherein the sub-cooler is arranged. For compensating volume fluctuations, such a circuit requires a compensation vessel, which is very expensive and can only be operated in the presence of a super-cooled medium when either a part of the medium is heated using external energy, or an inert gas which boils at very low temperatures is used as a pressure compensation medium. According to the disclosure, when a supply container for the liquid medium is integrated into the
(Continued)

Figure 1:
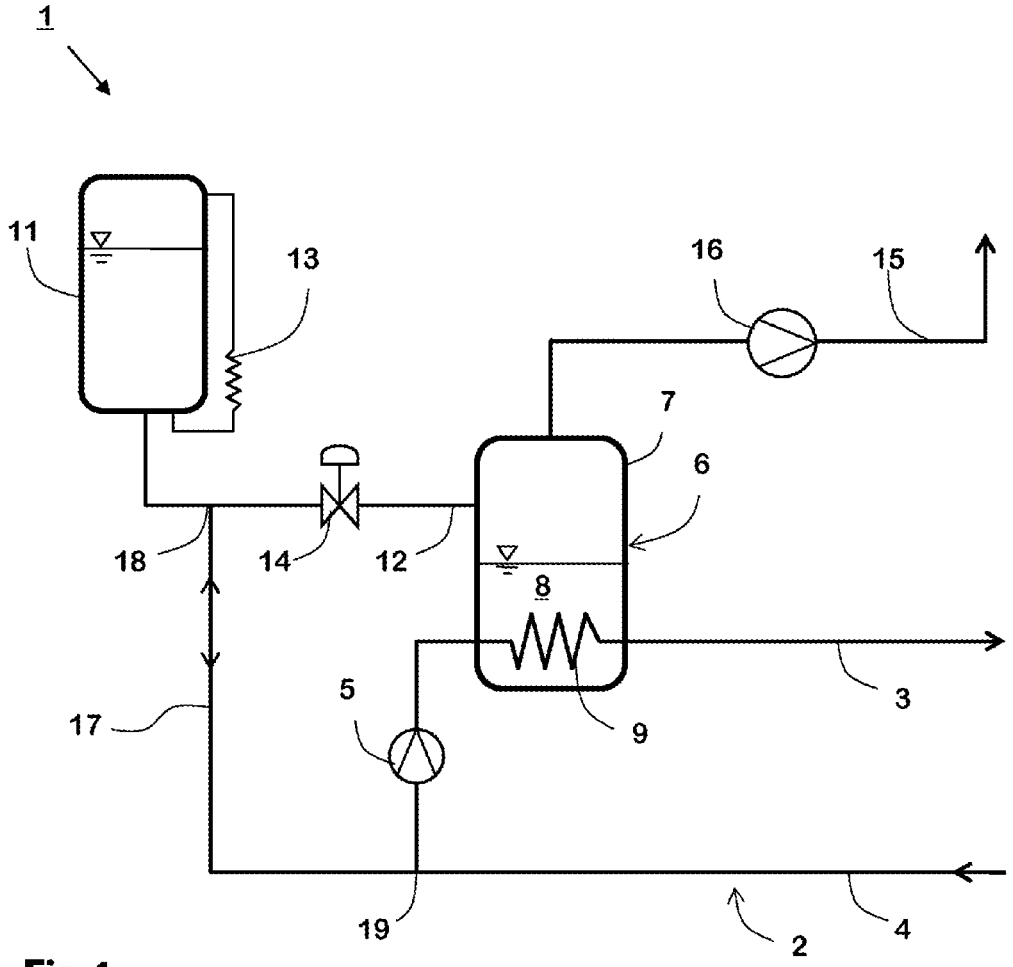

cooling circuit and used as a compensation vessel, a separate compensation vessel is not required.

7 Claims, 3 Drawing Sheets

(51) Int. Cl.
*F17C 9/00* (2006.01)
*F17C 13/00* (2006.01)

(52) U.S. Cl.
CPC ..... *F17C 2205/0326* (2013.01); *F17C 2205/0338* (2013.01); *F17C 2221/011* (2013.01); *F17C 2221/014* (2013.01); *F17C 2221/016* (2013.01); *F17C 2221/033* (2013.01); *F17C 2223/0161* (2013.01); *F17C 2223/033* (2013.01); *F17C 2223/046* (2013.01); *F17C 2225/0161* (2013.01); *F17C 2225/0169* (2013.01); *F17C 2225/033* (2013.01); *F17C 2227/0107* (2013.01); *F17C 2227/0135* (2013.01); *F17C 2227/0306* (2013.01); *F17C 2227/0374* (2013.01); *F17C 2250/0439* (2013.01); *F17C 2250/0626* (2013.01); *F17C 2260/056* (2013.01); *F17C 2265/017* (2013.01); *F17C 2265/022* (2013.01); *F17C 2270/05* (2013.01)

(58) Field of Classification Search
CPC ..... F17C 2227/0383; F17C 2221/033; F17C 2221/011; F17C 2221/014; F17C 2221/016; F17C 2250/0626; F17C 2223/0169; F17C 2227/0107; F17C 2227/0135; F17C 5/02; F25J 2205/02; F25J 2235/04; F25J 2270/02; F25B 45/00
See application file for complete search history.

(56) References Cited

U.S. PATENT DOCUMENTS

| | | | | |
|---|---|---|---|---|
| 3,303,660 | A | 2/1967 | Berg | |
| 4,638,638 | A * | 1/1987 | Marshall | F25J 1/0015 62/51.1 |
| 5,324,286 | A * | 6/1994 | Fowle | A61B 18/02 606/20 |
| 5,537,828 | A | 7/1996 | Borcuch et al. | |
| 5,557,925 | A * | 9/1996 | Kawamura | F16L 55/103 62/50.5 |
| 5,828,712 | A * | 10/1998 | Laurent | G01F 1/7048 376/246 |
| 7,617,848 | B2 | 11/2009 | Matheoud et al. | |
| 2005/0224514 | A1* | 10/2005 | Westenberger | F17C 1/00 222/3 |
| 2009/0308083 | A1 | 12/2009 | Brunner | |

FOREIGN PATENT DOCUMENTS

| | | | |
|---|---|---|---|
| EP | 1355114 | A2 | 10/2003 |
| GB | 980266 | A | 1/1965 |
| WO | WO-2006015927 | A1 | 2/2006 |

* cited by examiner

DEVICE FOR COOLING A CONSUMER WITH A SUPER-COOLED LIQUID IN A COOLING CIRCUIT

CROSS-REFERENCE TO RELATED APPLICATIONS

This application is a 371 U.S. National Stage of International Application No. PCT/EP2014/062881, filed Jun. 18, 2014, which claims the benefit of and priority to European Patent Application No. 102013011212.5, filed Jul. 4, 2013. The entire disclosures of the above applications are incorporated herein by reference.

The invention relates to a device for cooling a consumer, having, assigned to the consumer, a cooling circuit for circulating a cooling fluid, in which there is provided a pump and a super-cooler, wherein the super-cooler has: container which is fluidically connected, via a supply line equipped with an expansion valve, to a storage tank for the cooling liquid and which serves for accommodating a cooling bath; a gas removal line, arranged on the container, for discharging evaporated cooling liquid; and a heat exchanger which, during proper use of the device, is immersed in the cooling bath and is integrated into the cooling circuit.

Low-boiling liquefied gases, such as for example liquid nitrogen, liquid oxygen or liquefied noble gases, can be kept liquid only by means of particularly good insulation of the storage containers and of the pipes. The slightest incident heat radiation or friction heating can, depending on the boiling state, lead to partial vaporization. The partial vaporization causes boiling bubbles, which impair the intended cooling action, to collect in the cooling circuit. In order to counteract the partial vaporization, it is therefore advisable to super-cool the liquid prior to supplying it to a heat-producing consumer. "Super-cooling" is understood in the context of the present invention as the cooling of a liquid to a temperature below its boiling temperature at the respective pressure. In the case of high-boiling liquefied gases, such as for example carbon dioxide or fluorinated hydrocarbons, super-cooling is relatively simple to bring about. To that end, the liquid coolant in the storage tank is super-cooled by means of an electric cooling unit to the point that, during recirculation in an annular pipe system, no partial vaporization takes place as a consequence of incident heat radiation and friction losses. The units required for this are however very expensive to acquire and to operate, on account of their high power requirements.

DE 2929709 A1 describes a device for super-cooling a liquid. The device consists of a thermally insulated container in which there is accommodated a cooling bath of a liquefied cryogenic coolant and in the head space of which there is arranged a gas outlet valve. In the cooling bath, there is arranged a heat exchanger, for example a cooling coil, through which flows the liquid to be super-cooled. In order to super-cool the liquid, it is ensured that the pressure over the cooling bath is lower than the pressure within the cooling coil. Since although the cooling bath is in the boiling state but its pressure is reduced with respect to the pressure of the liquid to be super-cooled, its boiling temperature is below the boiling temperature of the liquid to be super-cooled, which liquid is thereby super-cooled and within which gas bubbles that have already formed are once again liquefied. The lower the pressure over the cooling bath, the lower also is its boiling temperature and the more effective is the super-cooling of the liquid in the cooling coil.

Such a super-cooler can now be used to cool a consumer, in that it is for example integrated into a cooling circuit assigned to the consumer. The super-cooler constantly supplies super-cooled cooling liquid to the consumer. In the case of such a configuration, it is possible to match the heat removed during super-cooling of the cooling liquid to the heat input from the consumer such that the cooling liquid does not reach its boiling temperature even during heat contact with the consumer, such that it is always in the liquid state in the cooling circuit.

In order to compensate for fluctuations in density or volume, in particular also in the event of irregular heat input, cooling circuits of this type should be equipped with an equalizing vessel in which there is, above a level of the cooling liquid, a gas for equalizing pressure. For example, EP 1 355 114 A2 describes a closed cooling circuit for cooling components, such as for example high-temperature superconducting cables, with a cryogenic liquid as cold transfer medium, in which an equalizing vessel assigned to the cooling circuit serves to maintain the cooling circuit at an elevated operating pressure of for example 2 bar to 20 bar, and to compensate for gas suddenly forming in the closed circuit and leakage losses. In that context, the equalizing vessel is directly connected to the cooling circuit and is filled with the same cryogenic liquid which also circulates in the cooling circuit.

However, the equalizing container integrated into the cooling circuit restricts the possibilities and in particular the temperatures with which the cooling circuit can be operated. In particular, in the case of cooling circuits which work with super-cooled liquids, pressure equalization by means of vaporized cooling liquid is either impossible or difficult since ingress of super-cooled liquid into the equalizing container would condense the gaseous coolant therein and would lower the pressure in the equalizing container to below the operating pressure. One possible solution would be to use a lower-boiling gas, for example helium, as the pressure equalizing gas in the gas chamber of the equalizing container or to provide, within the equalizing container, a separating membrane between the gas phase and the liquid phase. However, both of these involve great expenditure in terms of construction and maintenance.

The invention is therefore based on the object of creating a device for cooling a consumer using a super-cooled cooling liquid in a cooling circuit, in which pressure equalization in the cooling circuit is to be brought about with simple means.

This object is achieved, in the case of a device of the type and intended purpose mentioned in the introduction, in that, during proper use of the device, there branches off from the cooling circuit a flow-open connection line which is fluidically connected to the storage tank and/or or to the supply line leading to the cooling bath of the super-cooler, upstream of the expansion valve.

The device according to the invention thus comprises, in a manner known initially per se, a cooling circuit in which, in addition to the consumer, there is provided a pump for conveying the cooling liquid (the terms "cooling liquid" and "liquid coolant" are used synonymously in the following), and a super-cooler arranged upstream of the consumer. The super-cooler brings the cooling liquid to a temperature below its boiling temperature at the respective pressure, the super-cooling expediently being carried out to the point that the quantity of heat removed from the cooling liquid during the super-cooling at least compensates for the input of heat from the consumer, the pump and any pipe losses. The super-cooler comprises, integrated into the cooling circuit, a heat exchanger through which flows the liquid coolant to be super-cooled and which is accommodated in a cooling bath.

For its part, the cooling bath is accommodated in a pressure-tight and gas-tight container and consists of the same substance as the cooling liquid circulating in the cooling circuit, but is at a lower temperature than the latter. In order to achieve the low temperature of the cooling bath, the pressure of the gas phase over the cooling bath is set accordingly via a gas discharge, specifically to a value (referred to in the following as "target pressure") at which the boiling temperature of the cooling liquid in the cooling bath is below the boiling temperature of the cooling liquid in the cooling circuit. The temperature difference between the coolant in the cooling circuit is thus brought about essentially due to a pressure difference between the cooling bath and the cooling circuit. By virtue of the exchange of heat with the cooling bath, the cooling liquid in the cooling circuit is brought to a temperature below its boiling point (referred to in the following as "target temperature"). The difference between the boiling temperature in the cooling circuit and the target temperature is in that context determined essentially by the input of heat from the consumer, the pump and the pipes of the cooling circuit, and can in particular also be controlled in dependence on the heat input. In order to compensate for the loss of cooling liquid in the cooling bath, which takes place on account of the input of heat at the heat exchanger, the pressure vessel accommodating the cooling bath is fluidically connected to a storage tank for cooling liquid. The liquid supply line connecting the sump of the storage tank to the cooling bath is equipped with an expansion valve which ensures that the target pressure over the cooling bath is not exceeded. As liquid coolant, use is preferably made of a cryogenic liquefied gas, for example liquid nitrogen or a liquefied noble gas.

In order to achieve, in the cooling circuit, a pressure equalization necessary due to possible fluctuations in density or volume, use is made, according to the invention, of the storage tank itself. To that end, the storage tank is fluidically connected to the cooling circuit via a connection line which branches off from the liquid supply line upstream of the expansion valve and which, during proper use of the device, is always kept open to flow in both directions. In that context, the connection line opens into the storage tank itself or into the liquid supply line connecting the storage tank to the cooling bath in the super-cooler, in any case upstream of the expansion valve. In the event of a fluctuation in density or volume, it is thus possible for cooling liquid to flow from the storage tank into the cooling circuit or vice versa without this having a marked influence on the pressure ratios in the region of the cooling bath. The actual pressure equalization is brought about by the gas phase present over the cooling liquid in the storage tank. In particular if a large—in comparison to the volume of the cooling circuit—volume of cooling liquid is maintained in the storage tank, the quantity of cooling liquid in the storage tank and its hydrostatic pressure prevents super-cooled cooling liquid flowing via the connection line into the sump of the storage tank from lowering the temperature of the liquid coolant in the storage tank to the point that the gas phase in the storage tank collapses. The pressure in the storage container can however be maintained at a predefined pressure, possibly by means of a pressurization vaporizer, for example an air vaporizer, connected to the storage tank. A separate equalizing vessel is therefore not necessary in the cooling circuit, thus also simplifying the construction of the cooling device according to the invention with respect to cooling circuits according to the prior art, and avoiding the energy loss caused by the heat input into the equalizing vessel.

In one advantageous embodiment of the invention, a second super-cooler is arranged in the liquid supply line, upstream of the expansion valve but downstream of the mouth of the connection line into the liquid supply line. The second super-cooler prevents more than only an insignificant part of the liquid coolant existing in the gaseous state upon reaching the expansion valve, which would impair the functionality of the expansion valve and also influence the functionality of the first super-cooler (referred to in the following as "main super-cooler"). As second super-cooler, use is for example made of an object in which a line transporting the medium to be super-cooled is fed through a cooling bath and is thermally connected thereto, the temperature of the latter being lower than that of the medium fed through the line.

Another advantageous embodiment of the invention provides that a phase separator is provided in the supply line, upstream of the expansion valve and downstream of the branching-off point of the connection line. As phase separator, use is for example made of a container to which the medium to be separated is supplied and in which the medium separates into a liquid phase that collects at the bottom of the container (and is subsequently passed on to the super-cooler) and, above this, a gas phase (which is drawn off and possibly supplied to another use). The phase separator serves in particular to separate, from the liquid, flash gas from the connection line into the liquid supply line to the cooling bath of the main super-cooler, and not to allow this gas to reach the main super-cooler. The phase separator can moreover also be used to pre-cool the coolant fed to the main super-cooler. In this case, there is arranged, upstream of the phase separator but downstream of the branching-off point of the connection line, a further expansion valve, and the phase separator is operated at a pressure below the pressure in the sump of the storage tank, for example unpressurized (1 bar). The additional super-cooler or the additional phase separator relieve the main super-cooler and reduce the consumption of coolant in particular if a particularly low cooling temperature is to be achieved by applying a vacuum ($p<1$ bar) to the cooling bath of the main super-cooler.

The connection line can in principle open into the cooling circuit at any point of the latter, but it preferably opens into the cooling circuit upstream of the super-cooler in order to keep the temperature influences of the super-cooler on the storage tank as small as possible. In order to be able to particularly effectively equalize any density fluctuations in the region of the consumer, the connection line particularly preferably opens into the cooling circuit downstream of the consumer but upstream of the pump.

One advantageous development of the invention provides that the gas removal line is equipped with a vacuum pump. In this manner, the target pressure in the pressure container accommodating the cooling bath can be reduced to a value below ambient pressure, that is to say below 1 bar, and it is thus possible to achieve an even lower temperature in the cooling bath.

Advantageously, the storage tank is equipped with a pressurization vaporizer, for example an air vaporizer. This maintains a constant pressure in the storage tank.

Another preferred embodiment of the invention is characterized in that the temperature of the cooling bath can be controlled by means of a measuring and control device, in dependence on the heat input in the cooling circuit. Thus, for example, the temperature of the cooling liquid in the cooling circuit is detected constantly or at predefined time intervals and the determined values are fed to a control unit and compared to a setpoint value of the temperature. Then, the pressure in the pressure container accommodating the cooling bath is set by readjusting the expansion valve in the liquid supply and/or the vacuum pump at the gas outlet.

The device according to the invention is particularly suited to cooling a superconducting, in particular high-temperature superconducting, component. In this case, the consumer integrated into the cooling circuit is therefore a superconducting component, for example a superconducting cable or a superconducting magnet. In order to achieve and maintain the superconducting state, superconducting components of this type must be kept at a low operating temperature of, depending on the material and the load due to current and magnetic flux, between close to zero and currently (in the case of some high-temperature superconductors) approximately 140 K. In order to reach the operating temperature, the superconducting component is cooled, for example by means of liquid nitrogen, liquid helium or another liquefied gas. During operation, however, the superconducting components introduce nigh on no heat into the coolant; they are therefore particularly well-suited to cooling by means of a super-cooled liquid circulating in a cooling circuit.

EXAMPLE

In a cooling circuit for cooling a consumer, for example a superconducting cable, use is made as coolant of liquid nitrogen which circulates in the cooling circuit at a pressure of 8 to 10 bar. A super-cooler arranged in the cooling circuit brings the nitrogen to a temperature of −206° C. After passing through the consumer and the pump, the nitrogen is at a temperature, at the inlet of the super-cooler, of −200° C. The heat corresponding to the temperature difference is removed from the liquid nitrogen in that the pressure in the cooling bath of the super-cooler is brought, by means of a vacuum pump, to a value of for example between 0.15 and 0.2 bar. The pressure in the cooling circuit corresponds to the pressure at the sump of the storage container, such that the storage container according to the invention can be used as an equalizing vessel.

Figure 2:
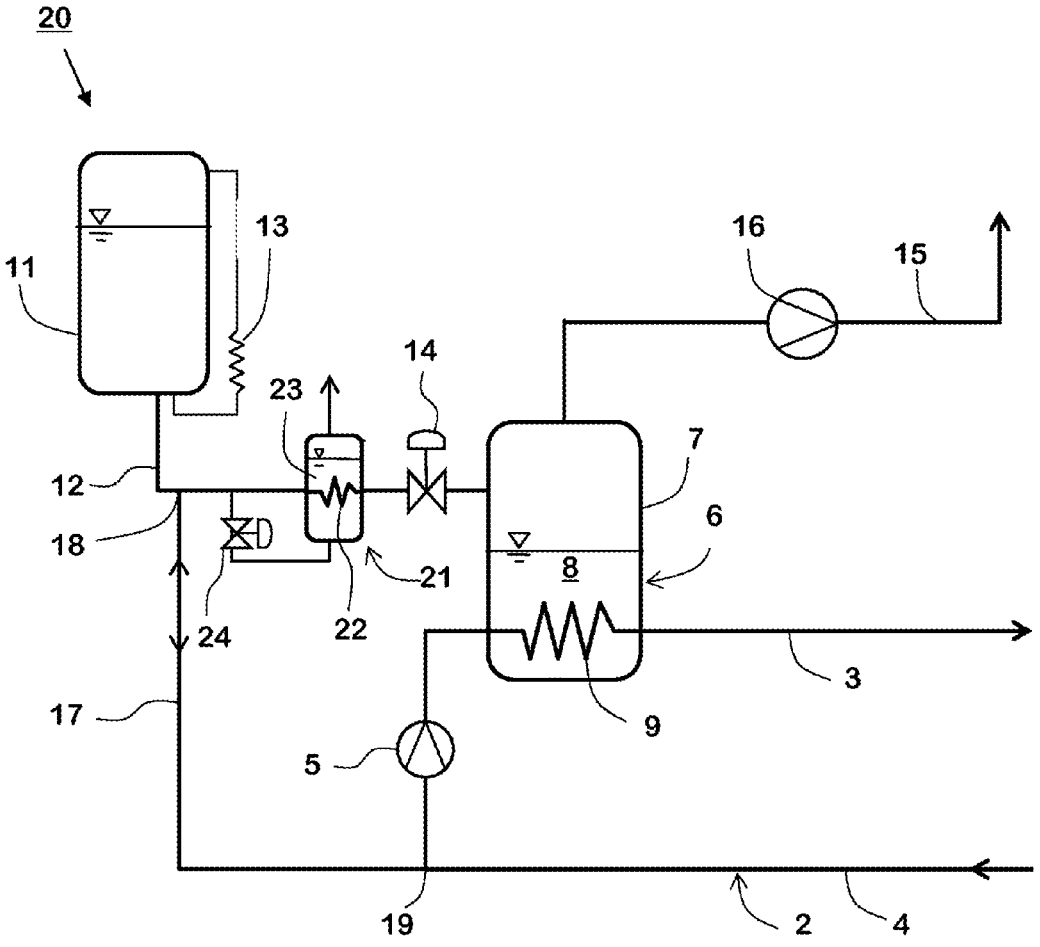
Figure 3:
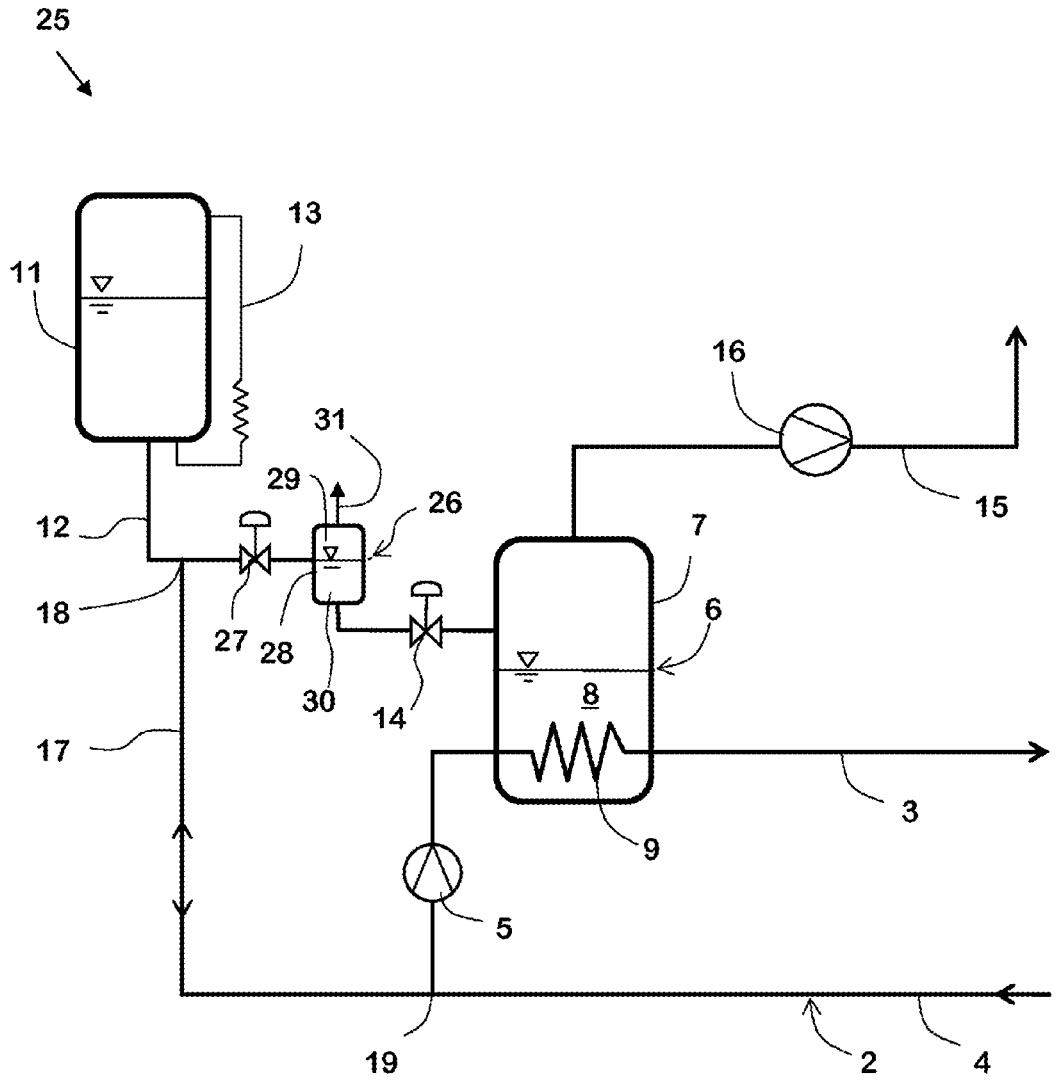

Exemplary embodiments of the invention are illustrated in schematic views of the drawings, in which:

FIG. 1 shows the circuit diagram of a device according to the invention in a first embodiment, FIG. 2 shows the circuit diagram of a device according to the invention in a second embodiment, FIG. 3 shows the circuit diagram of a device according to the invention in third first embodiment.

In the following, parts of the embodiments shown that have the same effect have in each case the same reference number.

The device 1 shown in FIG. 1 comprises a cooling circuit 2 for cooling a consumer (not shown here), for example a superconducting cable or magnet. The cooling circuit 2 comprises a forward-flow line 3 for supplying, to the consumer, a liquid coolant, in particular a cryogenic coolant such as for example liquid nitrogen, LNG or a liquefied noble gas, and a return-flow line 4 for removing liquid coolant from the consumer. The forward-flow line 3 and the return-flow line 4 are fluidically connected to one another, and a pump 5 conveys the liquid coolant within the cooling circuit 2.

A super-cooler 6 is arranged in the forward-flow line, downstream of the pump 5. The super-cooler 6 comprises a pressure container 7 in which there is accommodated a cooling bath 8. The forward-flow line 3, fed through the pressure container 7, enters the cooling bath 8 with a heat exchanger, for example a cooling coil 9. In order to supply fresh liquid coolant to the cooling bath 8, a supply line 12, which is connected to the sump of a storage tank 11, for example a standing tank, opens into the pressure container 7. The pressure in the storage tank 11 is in that context held at a predefined value by means of a tank pressure control unit, for example using an air vaporizer 13. In the supply line 12, there is arranged an expansion valve 14 by means of which it is possible to set a maximum pressure in the supply line 12 downstream of the expansion valve 14. In an upper region—which during proper use of the device 1 is filled with gaseous coolant—within the pressure container 7, there opens a gas removal line 15 into which a vacuum pump 16 is optionally integrated. The cooling circuit 2 and the fittings fluidically connected to the storage tank 11 are not fluidically independent of one another but rather are coupled to one another via a connection line 17 that, between a branching point 18 upstream of the expansion valve and a branching point 19 upstream of the pump 5, produces a flow connection between the supply line 12 and the cooling circuit 2.

When the device 1 is in operation, the liquid coolant flows through the cooling circuit 2. The pressure in the cooling circuit 2 essentially corresponds to the pressure at the bottom of the storage tank 11 and therefore has a boiling temperature that is higher than the boiling temperature of the coolant at the liquid surface in the storage tank 11. The coolant is fed in the super-cooled state to a consumer via the forward-flow line 3, and the coolant heated by heat contact with the consumer, and/or with pipe sections leading to or from the consumer, flows, still in the liquid and preferably in the super-cooled state, away from the consumer via the return-flow line 4 and is fed back into the forward-flow line 3 by means of the pump 5.

In order to ensure that the coolant is in the liquid state in the entire cooling circuit 2, the coolant in the forward-flow line 3 is cooled by the super-cooler 6 to a predefined temperature of for example 5 K to 10 K below its boiling temperature. The "predefined temperature" is chosen such that the total heat input in the cooling circuit 2 is insufficient—or at most just sufficient—to heat the super-cooled coolant to its boiling temperature. To that end, the coolant in the cooling bath 8 is brought to a lower pressure than the coolant in the cooling circuit 2, such that the boiling temperature at the pressure prevailing in the pressure container 7 is below the predefined temperature of the coolant in the forward-flow line 3. The required pressure is set at the expansion valve 14; if necessary, the pressure can also be reduced to a pressure of below 1 bar by using the vacuum pump 16. The gas removed via the gas removal line 15 is released to the atmosphere or is supplied to another use. It is also conceivable, within the scope of the invention, that the pressure in the pressure container 7 is controlled in dependence on a measured temperature of the coolant in the forward-flow line 3.

An equalizing volume is necessary in the case of pressure fluctuations arising during operation of the cooling circuit 2. In the case of the device 1, the storage tank 11 serves as such an equalizing volume since coolant can flow freely, via the connection line 19 which is open to flow in both directions during operation of the device 1, between the cooling circuit 2 and the storage tank 11. The pressurization vaporizer 13 provides any pressure buildup which may be required in the storage tank 11. Therefore, the device 1 does not require a separate equalizing vessel assigned to the cooling circuit 2. Since the branching-off point 18 in the supply line 12 is arranged upstream of the expansion valve 14, and the expansion valve 14 controls to a predefined end pressure, pressure fluctuations arising in the cooling circuit 2 do not lead to a notable influence on the pressure ratios in the container 7.

The device 20 shown in FIG. 2 differs from the device 1 only by an additional super-cooler 21 which is arranged in the supply line 12, upstream of the expansion valve 14. The super-cooler 21 has a heat exchanger 22 that is accommodated in a cooling bath 23. The cooling bath 23 is also supplied from the storage tank 11, with the difference however that an expansion valve 24 ensures that the pressure in the cooling bath 23 is lower than in the line 12, and thus the temperature of the cooling bath 23 is lower than the temperature of the coolant flowing through the heat exchanger 22. Super-cooling the coolant flowing through the supply line 12 prevents a substantial part of the coolant reaching the expansion valve 14 in the already vaporized state, which would harm the functionality of the expansion valve 14 and influence the performance of the super-cooler 6.

In the device 25 shown in FIG. 3, there is located, in the supply line 12, upstream of the expansion valve 14, a phase separator 26 and, upstream of the latter, a further expansion valve 27. The phase separator comprises a vessel 28 in which gaseous coolant, produced upstream of the phase separator 26 by vaporization of liquid coolant and/or introduced from the cooling circuit 2 via the connection line 19, collects in a gas phase 29 in the phase separator 26 while the coolant which has remained in the liquid state forms a liquid phase 30 in the phase separator 26. The liquid phase 30 is fluidically connected to the super-cooler 6 via that section of the supply line 12 downstream of the phase separator 26, while gas can be removed from the gas phase 29 via a gas discharge 31 fluidically connected to the gas phase 29. The phase separator 26 ensures, in a similar manner to the second super-cooler 21 in device 20, that immediately upstream of the expansion valve 14 there is no or only a small quantity of gaseous coolant in the supply line 12, thus avoiding disruption to the function of the expansion valve 14; at the same time, it can be used to pre-cool the coolant fed to the super-cooler 6 in that, during operation, the gas phase 29 is held at a lower pressure than the pressure at the bottom of the storage tank 11.

LIST OF REFERENCE SIGNS

1. Device
2. Cooling circuit
3. Forward-flow line
4. Return-flow line
5. Pump
6. Super-cooler
7. Pressure container
8. Cooling bath
9. Cooling coil
10. -
11. Storage tank
12. Supply line
13. Air vaporizer
14. Expansion valve
15. Gas removal line
16. Vacuum pump
17. Connection line
18. Branching-off point
19. Branching-off point
20. Device
21. Super-cooler
22. Heat exchanger
23. Cooling bath
24. Expansion valve
25. Device
26. Phase separator
27. Expansion valve
28. Container
29. Gas phase
30. Liquid phase
31. Gas discharge

The invention claimed is:

1. A device for cooling a consumer, comprising:

a cooling circuit for circulating a cooling fluid, in which there is provided a pump and a super-cooler, wherein the super-cooler has:

a container which is fluidically connected, via a supply line equipped with an expansion valve, to a storage tank for the cooling liquid and which serves for accommodating a cooling bath;

a gas removal line, arranged on the container, for discharging evaporated cooling liquid; and a heat exchanger which, during proper use of the device, is immersed in the cooling bath and is integrated into the cooling circuit, and characterized in that, the storage tank includes a volume of cooling fluid which is substantially greater than the volume of cooling fluid within the cooling circuit and, during use of the device, a flow open connection line having a first end and a second end, the first end fluidly connected to a branch point of the cooling circuit and the second end is fluidly connected to a branch point of the supply line, upstream of the expansion valve, and wherein when said cooling fluid within the cooling circuit becomes heated thereby building pressure, said fluid flows via the flow open connection line into the storage tank to relieve pressure within the cooling circuit thus maintaining a substantially constant pressure throughout the device.

2. The device as claimed in claim 1, wherein a second super-cooler is arranged in the supply line, between a mouth of the flow open connection line and the expansion valve.

3. The device as claimed in claim 1, wherein a phase separator is provided in the supply line, upstream of the expansion valve.

4. The device as claimed in claim 1, wherein the flow open connection line opens into the cooling circuit downstream of the consumer but upstream of the pump.

5. The device as claimed in claim 1, wherein the gas removal line is equipped with a vacuum pump.

6. The device as claimed in claim 1, wherein the storage tank is equipped with a pressurization vaporizer.

7. The device as claimed in claim 1, wherein a superconducting component is provided as the consumer.

* * * * *